United States Patent [19]

Leung

[11] Patent Number: 4,783,268

[45] Date of Patent: Nov. 8, 1988

[54] MICROBUBBLE FLOTATION PROCESS FOR THE SEPARATION OF BITUMEN FROM AN OIL SANDS SLURRY

[75] Inventor: Antony H. S. Leung, Sherwood Park, Canada

[73] Assignees: Alberta Energy Company, Ltd.; Canadian Occidental Petroleum Ltd.; Esso Resources Canada Limited, all of Calgary; Gulf Canada Resources Limited, Toronto; Her Majesty the Queen in right of the Province of Alberta, as represented by the Minister of Energy and Natural Resources, Edmonton; HBOG-Oil Sands Limited Partnership, Calgary; PanCanadian Petroleum Limited, Calgary; Petro-Canada Inc., Calgary, all of Canada

[21] Appl. No.: 138,069

[22] Filed: Dec. 28, 1987

[51] Int. Cl.[4] ..... C10G 1/04; B03D 1/00

[52] U.S. Cl. ..... 210/703; 210/706; 210/737; 208/391; 208/425

[58] Field of Search ..... 210/703–708, 210/737, 738; 208/390, 391, 425

[56] References Cited

U.S. PATENT DOCUMENTS

| | | | |
|---|---|---|---|
| 3,487,003 | 12/1969 | Baille et al. | 210/704 X |
| 3,764,008 | 10/1973 | Dorley et al. | 210/704 |
| 3,864,251 | 2/1975 | Cymbalisty | 210/703 |
| 3,869,384 | 3/1975 | Schutte | 210/703 |
| 4,018,664 | 4/1977 | Bain et al. | 208/391 |
| 4,383,914 | 5/1983 | Kiziof | 208/39 X |
| 4,395,337 | 7/1983 | Ciepiela | 210/703 |
| 4,514,305 | 4/1985 | Filby | 210/703 |

*Primary Examiner*—Tom Wyse

*Attorney, Agent, or Firm*—Ernest Peter Johnson

[57] ABSTRACT

An improvement is provided to the known hot water process for extracting bitumen from mined oil sand. More particularly, a methodology is provided for the production of microbubbles of air, and it has been found that the so-produced microbubbles can be used in the primary flotation/settling step of the hot water process to yield increased bitumen recovery. More particularly, a steam stream and an air stream in admixture are injected via a submerged nozzle into a flowing aqueous stream. A plurality of finely dispersed microbubbles are formed. These microbubbles have a diameter less than about 100 microns. The stream of microbubbles is injected into the diluted aqueous tar sand slurry formed in the hot water process. The injection is practiced following the conditioning step and prior to the introduction of the slurry into the flotation/settling step.

4 Claims, 2 Drawing Sheets

MICROBUBBLE FLOTATION PROCESS FOR THE SEPARATION OF BITUMEN FROM AN OIL SANDS SLURRY

FIELD OF THE INVENTION

The invention relates to an improvement to the known hot water process for extracting hydrocarbons (commonly referred to as 'bitumen') from mined oil sand. More particularly, the invention relates to a form of improved aeration in the process.

BACKGROUND OF THE INVENTION

Geological depositions of oil sand, also known as tar or bituminous sand, occur for example in the Athabasca region of Alberta, Canada.

Commercial processes for extracting and refining the bitumen to yield useful hydrocarbon products from the oil sand have long been in operation.

In these operations, the basic procedure involves removing the overburden and mining the oil sand. The hydrocarbon is then extracted from the oil sand utilizing a process known as the hot water process. The recovered hydrocarbon is upgraded in a hydrotreating facility to convert it to a refineable product.

It is the physical nature of the oil sand per se which renders it amenable to successful processing using the hot water extraction process.

The composition of oil sand comprises bitumen, water, quartz sand and clays. The quartz sand forms the major component. The clay particles are contained in a water matrix which forms a film around each sand grain. The bitumen is disposed in the interstices between the watersheathed grains. The presence of the water envelope, interposed between the hydrocarbon globules and sand grains, provides the basis whereby the bitumen may be separated from the sand by means of a water addition mechanism.

In order to successfully carry out the hot water process, it is necessary to first separate the bitumen from the solids particles and then selectively aerate the bitumen globules so that the latter float upwardly as a recoverable upper froth layer.

Thus the process relies on the density differentials within an aqueous slurry of the solids, water and bitumen, and the use of a selective separatory froth flotation process wherein the solids sink and the bitumen rises to form the froth.

More specifically, the first step of the hot water process involves an operation referred to as 'conditioning'. In this step, the mined oil sand is mixed in a horizontal rotating drum, or 'tumbler', with hot water and process aid (typically sodium hydroxide). The amounts of reagents added are in the following proportions: oil sand—3250 tons; hot water—610 tons; and NaOH—4 tons. The hot water is typically at a temperature of about 90° C. Steam is sparged into the drum contents at intervals along the length thereof to trim the temperature so that the slurry exit temperature is about 80° C. The residence time in the drum is about four minutes.

The conditioning operation is undertaken for several reasons. The water is added to displace the bitumen and solids particle away from each other. The hot water and steam cooperate to raise the temperature of the slurry. This will lower the viscosity of the bitumen and thus enhance its displacement from the solids by water. The higher temperature also increases the density differential between the bitumen and water. This facilitates the separation therebetween in the subsequent flotation/-separation stage which follows conditioning. Additionally, as the slurry undergoes agitation in the tumbler, beneficial entrainment of air bubbles therein results.

Following conditioning, the thick aqueous slurry is screened to remove rocks, oversize oil sand and clay lumps. The screened slurry is then diluted or 'flooded' with additional hot water before being pumped into the flotation/settling vessel (commonly referred to as the 'primary separation vessel' or 'PSV'). The thus diluted slurry will be referred to hereinafter as 'the diluted aqueous slurry'. The slurry at a point prior to its dilution will be referred to hereinafter as 'the slurry'.

The composition of the diluted aqueous slurry typically comprises 7% wt. bitumen; 43% wt. water; and 50% solids.

The diluted aqueous slurry is then pumped into the PSV. This open-topped vessel comprises a cylindrical upper section and a conical lower section. The aqueous slurry is retained in the PSV under quiescent conditions for a period of time, typically in the order of twenty-five minutes. The solids, largely sand, sink to the vessel bottom, are concentrated by the conical wall, and are withdrawn from the vessel as an underflow stream termed 'primary tailings'. A major portion of the bitumen, present in the form of suspended globules filmed over entrained air bubbles, rises rapidly to the top of the PSV to form bitumen-rich froth. This froth is termed 'primary froth'. Primary froth typically has a hydrocarbon content in excess of 60% wt.

Less buoyant or inherently less floatable bitumen, together with a substantial portion of the clay particles, remains in aqueous suspension between the settled sand and the floating froth layers. This suspension is referred to as 'middlings'. The aqueous phase of the suspension is termed 'process water'.

The hot water process further includes a secondary recovery circuit. More particularly, a stream of middlings is withdrawn from the PSV and passed through one or more serially connected sub-aerated flotation cells. The middlings are subjected therein to vigorous agitation and aeration. Bitumen-rich froth, termed 'secondary froth', is produced and recovered from the upper surfaces of the cells. The recovered secondary froth, usually having a hydrocarbon content of about 25%, is subsequently retained in a settling tank for a period of time to allow some contained water and solids to settle out. The remaining 'cleaned' secondary froth is then admixed with the primary froth to produce a combined froth product.

The secondary froth is considerably more contaminated with water and solids than is the case with the primary froth. More particularly, the primary froth might typically contain about: 66.4% wt. bitumen; 8.9% wt. solids; and 24.7% water. The secondary froth typically might contain about: 23.8% wt. bitumen; 17.5% solids; and 58.7% water.

It is, therefore, an objective in the operation of the hot water process to seek to maximize the recovery of the bitumen contained in the oil sand in the form of primary froth. That is to say, it is desirable that the bitumen report as primary froth rather than secondary froth. One also seeks always to maximize total bitumen recovery.

Before the combined froth can be advanced to the upgrading operation, it is first necessary to remove most of the water and solids therefrom. This is conventionally accomplished by means of a two-stage centrifuging circuit. In this circuit, the combined froth stream is first diluted with naphtha and then fed to a scroll centrifuge to separate off the bulk of the coarse solids. The product stream, comprising water, bitumen and fine solids, is then passed through a high-speed disc centrifuge to recover the bitumen.

Whilst many of the hot water process parameters have heretofore been extensively researched, relatively little research has been directed to the addition of air and its effects on primary froth recovery. This omission was perhaps a consequence of early development work, undertaken by the present assignee. Air injected into the primary separation vessel had resulted in an increase in the contamination by solids and water of the primary froth. Additionally, researchers had injected air into the tumbler, without finding any significant increase in primary froth recoveries. At the time of the present invention it was, therefore, the widely held belief in applicants' laboratory that air addition (as opposed to air entrainment in the tumbler) was either mildly deleterious in the process or was not a critical parameter either way.

SUMMARY OF THE INVENTION

In the early work leading up to the present invention, applicant commenced by injecting air alone into the slurry line carrying the diluted aqueous slurry. It was found that the oil content of the middlings was depressed a small amount (which is favorable), but the improvement was only minor and the total bitumen recovery was not significantly improved. It was postulated that the formed bubbles, (whose diameters were in the order of 4 mm, as derived from photographic studies) might be too large for efficient attachment with the minute bitumen globules.

Applicant postulated that if microbubbles of air could be introduced into the flowing diluted aqueous slurry stream, improved attachment between the bitumen globules and air might take place. This in turn could result in improved froth quality coupled with increased yield. However, heretofore, the techniques and equipment utilized for the generation of microbubbles typically involved mechanical spargers and the like. Whilst suitable for use in clean systems, such devices would rapidly become plugged and inoperative in the oily and high solids content fluids involved in the hot water process.

In accordance with one aspect of the present invention, therefore, a particularly methodology is provided for the production of microbubbles of air. This technique was found to yield minute air bubbles using equipment that would not plug. More specifically, a steam stream and an air stream in admixture are injected via a submerged nozzle into a flowing aqueous stream. A gaseous jet is formed at the outlet of the nozzle. At the boundaries of the jet, the eddies create vortices which entrain fluid into the jet. The steam and air stream is broken up into small bubbles which mix with the fluid. The steam component thereof condenses, leaving a plurality of minute, finely dispersed, uncondensed air bubbles. Typically, the diameter of these 'microbubbles' is of the order of less than about 100 $\mu$m. The microbubble size range may be varied by adjustment of the steam to air ratio and by selection of a suitable jet.

In another broad aspect of the present invention, it has been discovered that when a profusion of microbubbles of air are injected into the diluted aqueous slurry formed in the hot water process after the conditioning step, and prior to the introduction thereof into the flotation/settling zone, increased recovery of bitumen as primary froth may be obtained. Preferably the microbubbles are generated as previously described.

The gist of the invention therefore involves the combination of:

- mixing steam and air in a chamber;
- discharging the mixture as a pressurized jet into the diluted aqueous slurry of the hot water process, with resulting production of a dispersion of a multitude of minute air bubbles;
- practicing the aeration step on the diluted aqueous slurry before it enters the PSV; and
- discovering that the foregoing improves the yield of primary froth.

Broadly stated, the invention is an improvement in the hot water process, for extracting bitumen from mined oil sand in an extraction circuit, comprising conditioning the oil sand by admixing said oil sand with hot water and steam and an alkaline process aid and agitating the resultant slurry, diluting said slurry with additional hot water, passing the diluted aqueous slurry to a primary separation vessel and retaining the diluted aqueous slurry in the primary separation vessel under quiescent conditions to produce an underflow stream of tailings, an overflow stream of primary froth and a suspension of middlings therebetween. The improvement comprises injecting microbubbles of air into said diluted aqueous slurry after conditioning and prior to the introduction thereof into the primary separation vessel to thereby increase the recovery of primary froth, said microbubbles of air being generated by admixing a steam stream and an air stream and injecting said steam and air mixture into the diluted aqueous slurry stream whereby, as the steam component condenses, residual microbubbles of air are formed.

As a result of practicing the improvements described herein the following advantages were derived. First, the yield of bitumen in the form of primary froth was increased. Additionally, the methodology adopted for creating microbubbles involved the use of equipment which is not subject to plugging.

DESCRIPTION OF THE PREFERRED EMBODIMENT

The invention is an improvement on the known hot water extraction process for extracting bitumen from tar sand ores. More specifically, the invention involves aeration of the diluted aqueous slurry stream following conditioning and prior to the introduction of the slurry into the PSV.

Figure 1:
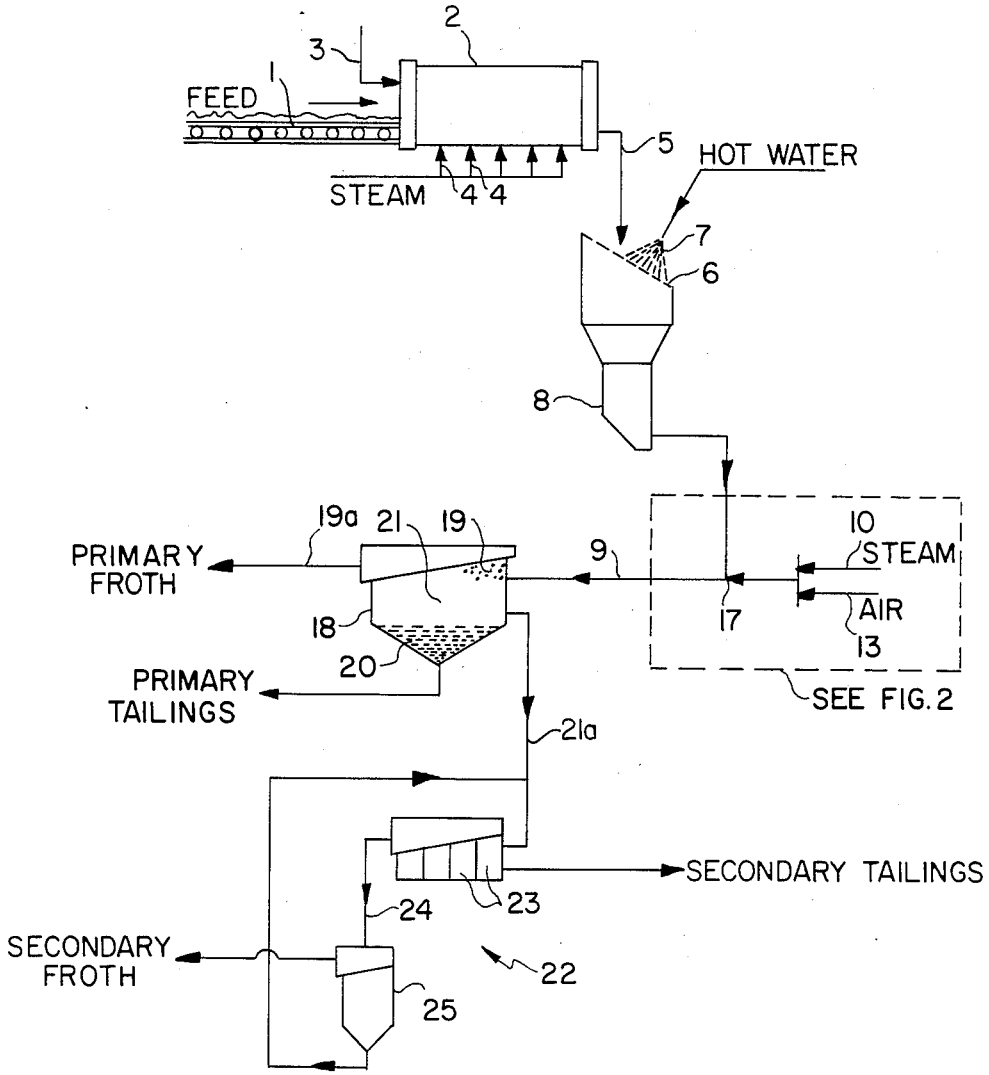
FIG. 1 is a schematic of the extraction circuit employed in the hot water process.
Figure 2:
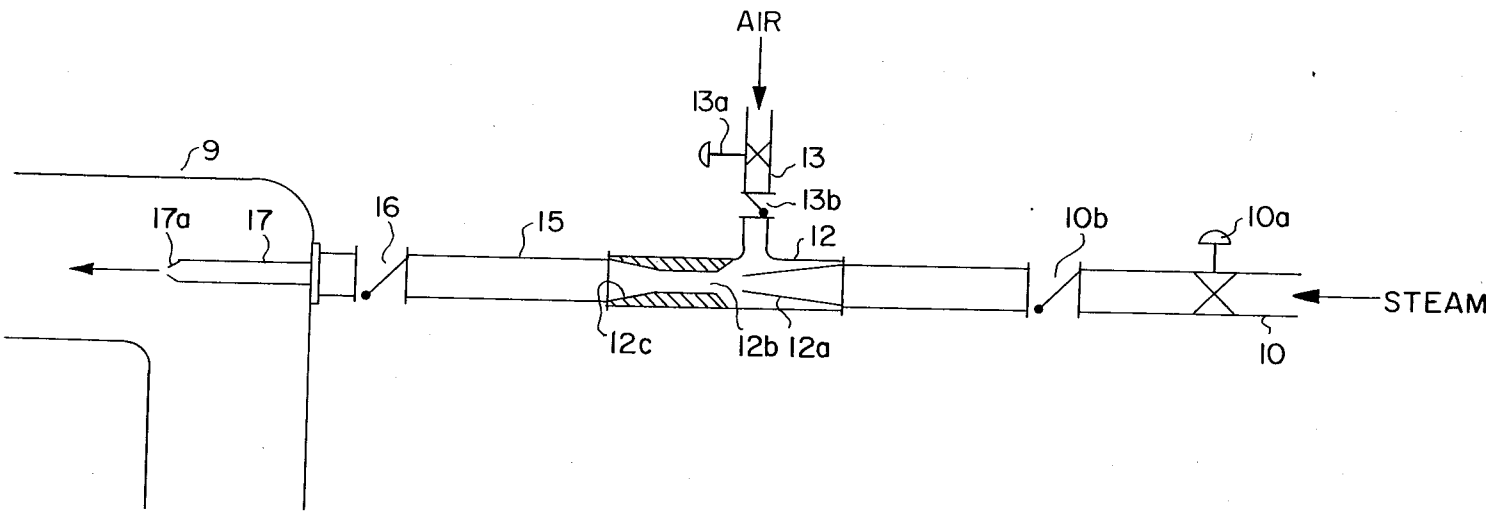
FIG. 2 is a sectional view of the equipment used for the injection of steam/air mixture into the diluted slurry.

The experimental work underlying the invention was carried out in a continuous pilot-scale hot water extraction circuit operating at a rate of about 2,270 kg/h. Results derived from the pilot plant, which is illustrated in FIG. 1, are correlatable to applicant's commercial plant operation. This experimental work and the results arising therefrom will now be described.

Oil sand feed, was fed by conveyor 1 to tumbler 2, wherein it was mixed with process aid (NaOH) and hot water (90°-95° C.) from conduit 3 to produce a slurry. The rate of oil sand addition was about 2.5 tonnes per hour. The rate of water addition was about 1.5 tonnes per hour. The sodium hydroxide was added at the rate of 0.02 wt. %, expressed as a percentage of oil sand feed. Steam was introduced to the slurry contained in tumbler 1 through sparging valves 4 to trim the exit temperature of the slurry to about 80° C. The residence time of the slurry in tumbler 2 was approximately 3½ minutes.

The slurry, prepared and conditioned in tumbler 2, was withdrawn by gravity flow through outlet line 5. It was then screened through a vibrating screen 6, sized to reject +¼ inch material and permit selective passage of the slurry therethrough. A continuous hot water wash from spray 7 was provided. Oversize reject material remaining on the screen was discarded.

The screened slurry was then diluted further with hot water added at pump box 8 to produce a diluted slurry containing about 50% solids by weight.

The diluted aqueous slurry was led from the pump box 8 and pumped through a conduit 9, into which microbubbles of air were introduced co-currently therewith.

The generation of microbubbles was carried out as follows:

A stream of steam was supplied via line 10. This line 10 included a variable control valve **10*a* and a check valve 10*b*. The steam supplied by line 10 was jetted through nozzle 12*a* into the mixing chamber 12*b* of a mixing tube 12. A stream of air was supplied via line 13 to the mixing chamber 12*b* at the outlet of the nozzle 12*a*. Line 13 included a control valve 13*a* and a check valve 13*b*. In mixing chamber 12*b*, the steam and air commingled in a controlled ratio. From mixing chamber 12*b*, the steam air mixture passed through an orifice 12*c*, a line 15, having a check valve 16, and through a nozzle 17. The nozzle 17 was positioned at an elbow of the slurry line 9. The outlet 17*a* of the nozzle 17 was in communication with the interior of the line 9**.

The dimensions of the equipment used were as follows:

inside diameter of line 9—25 mm
inside diameter of line 10—9.4 mm
inside diameter of mixing tube 12—10 mm
diameter of outlet of nozzle **12*a***—3 mm
orifice diameter—6 mm
inside diameter of tube 15—9.4 mm
inside diameter of nozzle 17—2 mm
diameter of outlet **17*a* of nozzle 17**—1.5 mm Typically, the steam and air to oil sands ratios were 2.7 gm of 550 kPa steam and 0.1 L of air at STP per kg of oil sand.

The air bubbles obtained with the equipment and materials described were generally less than 100 μm in diameter. This was determined by photographic method.

Following aeration, the slurry was passed into the primary separation vessel or PSV 18. The slurry was retained in PSV 18 under quiescent conditions to permit development of the bitumen-rich primary froth 19, the settled solids primary tailings 20 and the middlings 21. The primary froth 19 was conducted off through line **19*a* to a froth purification circuit (not shown). The primary tailings 20 were withdrawn and discarded. A stream of middlings was continuously withdrawn through middlings outlet line 21*a* and advanced to the secondary recovery circuit 22**.

The secondary recovery circuit 22 comprised serially connected sub-aeration and flotation cells 23, of conventional design. Each cell 23 was provided with an agitator and inlet distributor (not shown). Underflow reject from the first cell was progressively advanced as feed to the adjacent cell. Underflow from the final cell was discarded as a tailings stream. Secondary froth was led from the cells 23 via conduit 24 to a settler 25, wherein some solids and water settled out to leave cleaned secondary froth.

The following examples, which are derived from experiments conducted in the above-described continuous pilot plant, are included to demonstrate the present invention.

EXAMPLE 1

This example provides a comparison between the standard hot water process and the steam/air microbubble injection process of the invention, carried out on an oil sand containing 10.6% oil and 30% fines. The results of runs, conducted in accordance with the foregoing, are given in Table 1 herebelow:

TABLE 1

| % Oil in Middlings | % Oil in Primary Tailings | % Primary Froth Recovery | Process Utilized |
|---|---|---|---|
| 3.2 | 0.5 | 81 | no air injection (standard hot water process) |
| 2.0 | 0.5 | 86 | air injection alone into the aqueous slurry conduit |
| 0.7 | 0.4 | 93 | steam/air mixture injection into the aqueous slurry conduit |

EXAMPLE 2

This example shows a comparison between a case wherein the process is conducted without the benefit of air injection and a case wherein the process is conducted with steam/air injection i.e. injection of microbubbles of air into the slurry transfer pipe, for an oil sand different in composition than that of Example 1 and with a change in the rate of air addition. More particularly, the oil sand contained 8.7% oil and 33% fines. A mixture of steam/air was used in the following proportions: 2.7 g steam and 0.1 l of air per 1 kg of oil sand feed. The results obtained are set forth in Table 2 following herebelow:

TABLE 2

| % Oil in Primary Tailings | % Primary Recovery | % Total Recovery | Process Utilized |
|---|---|---|---|
| 1.3 | 32 | 73 | (standard hot water process - no air injection) |
| 1.1 | 53 | 79 | (injection of microbubbles of air into the slurry pipe) |

The embodiments of the invention in which an exclusive property or privilege is claimed are defined as follows:

1. In the hot water process for extracting bitumen from mined oil sand in an extraction circuit said process comprising conditioning the oil sand by admixing said oil sand with hot water and steam and an alkaline process aid and agitating the resultant slurry, diluting the so conditioned slurry with additional hot water, passing the diluted aqueous slurry to a primary separation vessel and retaining the diluted aqueous slurry in the primary separation vessel under quiescent conditions to produce an underflow stream of tailings, an overflow stream of primary froth and a suspension of middlings therebetween, the improvement which comprises:

injecting microbubbles of air into said diluted aqueous slurry after conditioning and prior to the introduction thereof into the primary separation vessel to thereby increase the recovery of primary froth, said microbubbles of air being generated by admixing a steam stream and an air stream and injecting said steam and air mixture into the diluted aqueous slurry stream whereby as the steam component condenses, residual microbubbles of air are formed.

2. The improvement as set forth in claim 1 wherein the microbubbles have a diameter less than about 100 microns.

3. The improvement as set forth in claim 1 or 2 wherein said steam and air mixture is injected co-currently with the flow of diluted aqueous slurry into said separation vessel.

4. The improvement as set forth in claim 2 wherein the mixture of steam and air is injected through a nozzle into the diluted aqueous slurry.

* * * * *